US009427743B2

(12) United States Patent
Leone et al.

(10) Patent No.: US 9,427,743 B2
(45) Date of Patent: Aug. 30, 2016

(54) SPIRAL JET MILL APPARATUS FOR MICRONISATION OF A POWDERED MATERIAL OR A MATERIAL CONTAINING PARTICLES IN GENERAL, WITH A NOVEL SYSTEM FOR FEEDING AND DISPENSING THE POWDERED MATERIAL TO BE MICRONISED, AND CORRESPONDING PROCESS FOR MICRONISATION OF A POWDERED PRODUCT

(71) Applicant: MICRO-MACINAZIONE S.A., Molinazzo Di Monteggio (CH)

(72) Inventors: Milko Leone, Molinazzo Di Monteggio (CH); Simone Frattini, Molinazzo Di Monteggio (CH); Matteo Gamberoni, Molinazzo Di Monteggio (CH)

(73) Assignee: MICRO-MACINAZIONES S.A. (CH)

( * ) Notice: Subject to any disclaimer, the term of this patent is extended or adjusted under 35 U.S.C. 154(b) by 35 days.

(21) Appl. No.: 14/394,678

(22) PCT Filed: Apr. 16, 2013

(86) PCT No.: PCT/EP2013/057881

§ 371 (c)(1),
(2) Date: Oct. 15, 2014

(87) PCT Pub. No.: WO2013/156465

PCT Pub. Date: Oct. 24, 2013

(65) Prior Publication Data

US 2015/0083830 A1 Mar. 26, 2015

(30) Foreign Application Priority Data

Apr. 17, 2012 (IT) ..... MI2012A0635

(51) Int. Cl.
*B02C 19/06* (2006.01)
*B02C 23/02* (2006.01)

(52) U.S. Cl.
CPC ..... *B02C 19/06* (2013.01); *B02C 23/02* (2013.01)

(58) Field of Classification Search
CPC ..... B02C 19/06; B02C 17/00; B02C 19/061; B02C 19/068
USPC ..... 241/1, 5, 25, 39, 101.8, 40, 41, 47, 15, 241/30, 34, 100
See application file for complete search history.

(56) References Cited

U.S. PATENT DOCUMENTS 5,992,773 A * 11/1999 Schwechten ..... 241/5

FOREIGN PATENT DOCUMENTS

| | | |
|---|---|---|
| DE | 1135274 B | 8/1962 |
| WO | 03029762 A1 | 4/2003 |
| WO | 2010011881 A1 | 1/2010 |

OTHER PUBLICATIONS

International Search Report and Written Opinion for International Application No. PCT/EP2013/057881 mailed Aug. 19, 2013 (10 pages).

*Primary Examiner* — Mark Rosenbaum
(74) *Attorney, Agent, or Firm* — Merchant & Gould P.C.

(57) ABSTRACT

Apparatus (10) for the micronisation of a powdered material (P) containing particles, comprising: a container (11), containing a reserve of the powdered product (P) to be micronised; a high-energy gaseous spiral fluid-jet micronising mill (12) with which powdered product (P) is micronised; and a feed system (13) to feed powdered product (P) from container (11) to the spiral jet mill (12), wherein feed system (13) comprises a special microdispenser device (20, 21, 26, 27, 28, 29) that micrometrically dispenses and directly feeds the powdered material (P), in a dense state, to the spiral jet mill (12), and wherein said microdispenser device (20) comprises one or more dispensing sections (21) which are cyclically filled with material originating from container (11) and then emptied to feed the material to the spiral jet mill (12), opening and closing at high frequency a plurality of control valves (26, 27, 28 and 29) associated with the dispensing sections (21) of the microdispenser device (20).

4 Claims, 5 Drawing Sheets

SPIRAL JET MILL APPARATUS FOR MICRONISATION OF A POWDERED MATERIAL OR A MATERIAL CONTAINING PARTICLES IN GENERAL, WITH A NOVEL SYSTEM FOR FEEDING AND DISPENSING THE POWDERED MATERIAL TO BE MICRONISED, AND CORRESPONDING PROCESS FOR MICRONISATION OF A POWDERED PRODUCT

This application is a National Stage Application of PCT/EP2013/057881, filed 16 Apr. 2013, which claims benefit of Serial No. MI2012A000635, filed 17 Apr. 2012 in Italy, each of these applications being incorporated herein by reference. To the extent appropriate, a claim of priority is made to each of the above disclosed applications.

TECHNICAL FIELD OF INVENTION

The present invention relates in general to the sector of devices and apparatus for grinding and crushing materials and products containing and formed by particles, such as, typically, powders, products and similar compounds in powdered form, into smaller particles, and in particular relates to an apparatus for the micronisation of a powdered product or similar substance comprising a micronising mill operating with high-energy jets of a gaseous fluid such as air, which said mill uses a novel, innovative system of dispensing the powdered material and product to be micronised and feeding it to the jet mill.

The present invention also relates to a corresponding process for the micronisation of a powdered product.

BACKGROUND OF THE INVENTION AND PRIOR ART

Current technology for crushing powders, such as powdered compounds for use in the pharmaceutical industry and powdered material in general, offers numerous solutions, some of which are alternative to one another, including powder micronisation systems based on the use of a high-energy gaseous-fluid-jet mill, also called a jet mill.

Said jet mills have a relatively simple construction and structure, normally comprising: a circular grinding or micronisation chamber wherein a series of high-energy jets, generated by a compressed gaseous fluid such as air, cause continuous collisions between the powdered product particles, and consequently their micronisation; a system of feeding and loading the powdered material into the micronisation chamber based on the use of a Venturi tube, also simply called a Venturi, namely a narrowing or throat in a pipe into which a gaseous fluid is conveyed so as to cause a negative pressure that attracts the powdered material; and a selection or classification system, of the static or dynamic type, associated with a central zone of the micronisation chamber and designed to classify the crushed and micronised particles and separate them selectively according to particle size.

The high-energy jets of gaseous fluid are inclined in relation to the radius of the micronisation chamber, with the result that said jets cause a fluid dynamic flow of gaseous fluid in said chamber that draws the particles of powdered material with it and presents two components: a first tangential component that rapidly moves the particles of powdered material in a vortex around the axis of the micronisation chamber, and a second radial component that tends to move the particles from the peripheral zone to the central zone of the micronisation chamber.

In this way, the powdered material or product is subjected, in said fluid dynamic flow in the micronisation chamber, to continual mixing and collisions between its particles.

Moreover, in the flow generated by the high-energy jets of gaseous fluid, the particles are subject to a centrifugal force that also leads to classification, whereby the finer and already micronised particles tend to move towards the central inner part of the micronisation chamber, from which they are evacuated, while the larger ones, not yet micronised, tend to remain in the peripheral outer zone of the micronisation chamber and to rotate around the axis on the periphery, thus undergoing further collisions.

The micronisation process is normally but not solely performed on powdered materials and practically dry powders.

Improvements over the years have led to optimisation of the configuration and geometry of the holes or nozzles through which the high-pressure jets of gaseous fluid are activated and created, both in the micronisation chamber and in the micronised particle classification system, where a dynamic classifier has been introduced in particular, already used in other types of apparatus, which uses a rotary element with peripheral wings that only allows micronised particles of the required size to pass through.

Nevertheless, current micronisation technology, including that based on the use of jet mills, still presents problems and limitations that need to be overcome and solved with further improvements, especially as regards feeding of the powdered material to be micronised to the micronisation chamber of the jet mill.

In particular, the current system of feeding the powdered material to be micronised, typically comprising a Venturi tube, as already stated, presents the following problems and drawbacks.

- Noise level of Venturi tube. The presence of a Venturi tube means that the feed system is rather noisy. This noise can only be partly attenuated by suitably closing the feed section.
- Abrasion of Venturi tube. The Venturi is subject to abrasion over time, due to the passage of the powder. This abrasion phenomenon is particularly accentuated in the throat area of the Venturi tube, causing a reduction in its efficiency with a variation in the operation of the jet mill.
- Blockage of Venturi tube. This phenomenon, also called "blow-back", is particularly accentuated with fatty, electrostatic or damp powders, and tends to project the powder back through the entrance cone of the Venturi tube, thus preventing correct operation of the jet mill.
- Irregularity of the dispensed material to be micronised, i.e. an irregular, imprecise quantity of powdered material, which is fed through the Venturi tube to the jet mill. With the dispensing systems normally used at present, such as single- or double-screw or rotary-valve dispensers, the powder flows into the Venturi tube in an irregular, uncontrolled way, with the result that the quantity of powdered material dispensed by said dispensing systems and the corresponding particle size vary over time, in an uncontrolled way.
- Limitation of the ratio obtainable between the quantity of powder dispensed and the operating pressure of the gaseous fluid in the jet mill. As the Venturi feed system communicates directly with the micronisation chamber of the jet mill, its operation is necessarily dependent on the conditions in said chamber, so in order to obtain the negative pressure involved in the Venturi effect, the pressure of the gaseous fluid in the Venturi tube must be at least equal to that of the gaseous fluid in the zone of the nozzles that dispense the high-energy jets for micronisation of the powder. Moreover, for each grinding or micronisation pressure value there is a minimum quantity of powder, dependent on the density, size and other characteristics of the powder which must be fed into the micronisation chamber to allow the operation of the mill and prevent blow-back.

Finally, a further drawback of the current technology which needs to be remedied, again associated with the use of a Venturi type feed system, is that with said Venturi system it is practically impossible to control and feed to the jet mill relatively low flow rates or quantities of the material to be micronised, and at the same time operate with high operating pressures in the jet mill to activate the high-energy fluid jets for micronisation of the powdered material.

Furthermore, it is remarked that screw feeders, as those adopted in the actual technique, for feeding and transporting powders, have relevant problems related to the metal abrasion during the feeding, that can contaminate the final product.

Moreover screw type feeders cannot inject powders directly into a jet mill.

Indeed, as before discussed, in order to inject the powders an additional tool for acceleration and injection of the powders is required, as for example a Venturi type pneumatic feeder that aspirates the powder leaving the screw and finally blow it with high gas consumption into the spiral mill.

Beneath all mentioned disadvantages and limitations the screw feeder and the Venturi system underlay and imply strong wear if abrasive powders have to be transported.

Still, screw type feeders cannot feed sticky powders or powders with low or no flowing behavior (e.g. flake like powders, short fibres or most of powders with average particle size below 10 microns down to nanometers) and cleaning is very difficult and time consuming.

It is also remarked that the nowadays increasing demand of powders with submicron and nanometre sized particles requires efficient production methods, and the actual state of the art of jet milling technologies appears as not being capable of completely fulfilling this task, as above outlined.

For instance, blocky shape abrasive diamond powders with a particle size below 10 microns cannot be efficiently transported by using a screw type feeder, as those adopted at present in the technique.

Moreover also the methods for producing powders, in particular with low impurities, to be used in application involving grinding or lapping, as diamond powders, SiC (Silicon Carbide), WC (Tungsten Carbide), CBN (Cubic Boron Nitride) and B4C (Boron Carbide) powders, appear to require further improvements.

PURPOSE AND SUMMARY OF THE INVENTION

A first purpose of the present invention is therefore to provide a novel apparatus for micronisation of powders, in particular of the type comprising a high-energy fluid-jet mill, which eliminates the above-mentioned drawbacks present in the prior art, and above all can control and precisely dispense the quantity of powdered material fed to the micronisation apparatus, i.e. to the corresponding jet mill, to be micronised.

A further more general purpose of the present invention is also to increase the overall efficiency of the micronisation process used for powders and similar materials, by means of precise control and dispensing of the quantity of powdered material fed to the zone in which said material will be micronised.

A third purpose of the present invention is to find a solution that allows the jet mill to be fed with low flow rates and quantities of material to be micronised, at the same time operating with high operating pressures to generate the fluid jets in the mill, as required to obtain optimum micronisation of superior quality with given types of powdered materials.

Finally, a fourth purpose of the present invention is to improve and make even more efficient and controllable the micronisation of powders and powdered compounds specifically designed for use and application in the pharmaceutical field, an industry in which said needs for increasing efficiency of the micronisation process and increasingly high quality of the micronised product are particularly felt.

Moreover another possible purpose of the invention can be directed to improve the actual technique for producing powders, in particular with low impurities, and thereby produce improved and more efficient powders, to be used in application involving grinding or lapping, as diamond powders, SiC (Silicon Carbide), WC (Tungsten Carbide), CBN (Cubic Boron Nitride) and B4C (Boron Carbide) powders, and other types of powder.

Said purposes can be deemed to be fully achieved by the powder micronisation apparatus having the characteristics defined in independent claim 1.

Particular forms of embodiment of the present invention are defined by the dependent claims.

In the powdered material micronisation apparatus of the present invention the jet-mill is specifically of the spiral type, that means that the nozzles are forming a circle, and are not all directed towards one point, as in other micronization systems, like for instance the fluidized bed jet-mills with opposite nozzles, and thereby with jet trajectories incident in a common point.

Moreover an essential feature of this proposed powdered material micronisation apparatus, compared to the systems at present known, is the combination of a spiral jet-mill, instead of a opposite jet mill, with a new generation of powder feeders, of the type of a powder pump, implying better milling results at higher efficiencies and lower impurities level, as those caused by wear, without limitations of powders to be handled.

Even flakes or fibres can be precisely injected into the mill.

In particular the system or apparatus here proposed is composed by only one single feeding step, and the feeder is a so called powder pump without any mechanical moving parts in contact with the powder.

The feeding of the powder is made in a volumetric way and in a dense phase mode instead of the traditional mechanical and pneumatic transport of the powder.

Therefore the powder is flowing at low speed to the milling chamber (normally by the factor 3 to factor 10 lower particles speeds compared to pneumatic powder feeding). This reduce dramatically the wearing, and makes easy the control of final feed-rates. No limitations are indentified by the applicant regarding the powders to be handled. With multiple feeding parts in series the synchronization is fundamental to avoid clogging or emptying of the feeding line

Advantages of the Invention

There are numerous advantages, some of which have been implicitly stated above, associated with the novel powder micronisation apparatus according to the present invention, such as those listed in below by way of example:

- greater efficiency and yield of the micronisation process compared with conventional systems that use a Venturi tube to feed the material to be micronised;
- more precise control over time of the quantity of powdered material subjected to the micronisation process;
- the ability to obtain a micronised powder complying with the desired quality requirements with relatively low flow rates of the material to be micronised.

BRIEF DESCRIPTION OF DRAWINGS

These and other purposes, characteristics and advantages of the present invention will clearly appear from the following description of a preferred embodiment thereof, given by way of example but not of limitation, by reference to the annexed drawings, wherein:

FIG. 1 is a scheme illustrating an apparatus according to the present invention for the micronisation of a powdered material or the like;

Figure 1:
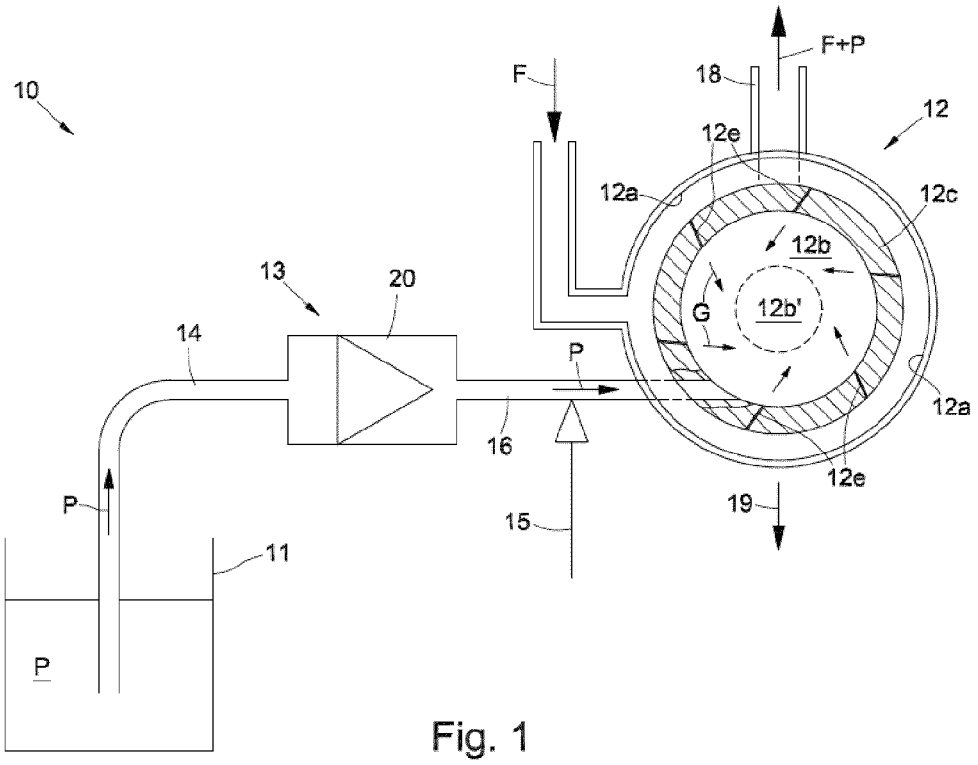

DESCRIPTION OF A PREFERRED EMBODIMENT OF THE MICRONISATION APPARATUS ACCORDING TO THE INVENTION

With reference to the drawings, an apparatus or unit, conforming to the present invention, for grinding or micronisation of a material containing and formed by particles to be micronised, typically constituted by a product, compound, substance or powdered material P in general, is indicated as a whole as 10, and comprises in particular:

- a container or receptacle 11, containing a basic reserve of powdered material or product P, also called "the powder", to be micronised;
- a micronising mill 12, of the spiral jet type, wherein the powdered material or product P is micronised; and
- a feed system, indicated in general as 13, designed to feed the powdered product or material P from container 11 to jet mill 12, where it is micronised.

In detail, feed system 13 operates so as to aspirate and attract powdered product P from container 11, along a first transport or entrance line 14, and then feed it to jet mill 12, along a second transport or exit line 16.

In this way, powdered product P is conveyed along the first transport line 14 installed upstream of feed system 13, and subsequently conveyed along the second transport line 16, installed downstream of feed system 13, from container 11 to jet mill 12, where powdered product P is micronised.

As jet mill 12 possesses substantially known characteristics, it is only schematically illustrated in the drawings, and will not be described in detail.

It will merely be mentioned that jet mill 12 comprises an annular outer pressure chamber 12*a* and a circular inner micronisation chamber 12*b*, separated from one another by an annular intermediate wall 12*c* in which are drilled a plurality of channels or through holes 12*e*, suitably inclined relative to the radius of micronisation chamber 12*b*, which place the two chambers 12*a* and 12*b* in communication.

In operation, jet mill 12 is supplied with a fluid F, in particular air, at high pressure, which is introduced into outer pressure chamber 12*a*, and emerges, in jet form, in inner micronisation chamber 12*b* through channels 12*e*, formed in annular separation wall 12*c* between the two chambers 12*a* and 12*b*.

In this way a system of high-energy jets G is generated, which are inclined and tangential to an imaginary circle, and which cause a vortical motion and an air spiral around the axis of micronisation chamber 12*b*, converging towards a central area 12*b*' thereof.

Powdered material P in turn is fed by feed system 13 to inner micronisation chamber 12*b* of jet mill 12, with the result that particles of powdered material P are drawn by the vortical motion generated by jets G in micronisation chamber 12*b*, and are consequently liable to collide continually with each other and be crushed, so as to micronise powdered material P.

In particular, in the micronisation chamber, due to said vortical motion, the particles of powdered product P are subject to a centrifugal force that tends to move them towards annular wall 12*c*, so that they remain in the micronisation zone until the particles exceed a given size or have not yet been sufficiently crushed.

When said particles have been completely crushed, they are subjected to a radial force that tends to move them towards central zone 12*b*' of micronisation chamber 12*b*, whence they are evacuated.

The vortical motion in the micronisation chamber therefore acts in such a way as to classify the particles and determine their evacuation, once micronised.

Micronisation apparatus 10 also contains an evacuation system, schematically illustrated with a pipe 18 and fitted at the outlet of jet mill 12, which has the function of evacuating from micronisation chamber 12*b* the gaseous flow consisting of fluid F and the material, indicated as P', containing the particles of micronised powder, and conveying them to a separation system with known characteristics not shown in the drawings, designed to separate and collect the micronised particles from gaseous fluid F.

Optionally, micronisation apparatus 10 can also be fitted with an auxiliary exit, schematically illustrated by arrow 19, to recover the powder from jet mill 12.

Optionally, micronisation apparatus 10 can also contain, along transport line 16 fitted downstream of microdispenser device 20, a coaxial disperser 15 with known characteristics, schematically illustrated with an arrow in FIG. 1, which has the function of dispersing the particles of powder so as to optimise their distribution in the flow fed to micronisation chamber 12*b*.

According to one characteristic of the present invention, feed system 13 of micronisation apparatus 10 comprises, alternatively to conventional feed systems usually based on a Venturi tube, a microdispenser device 20, which dispenses powdered product P micrometrically, and feeds it or injects it directly into micronisation chamber 12*b* of jet mill 12.

Due to said microdispenser device 20, and unlike conventional Venturi type feed systems, which do not usually allow precise dispensing and control of the quantity of powdered material introduced into the jet mill to be micronised, in micronisation apparatus 10 according to the present invention the quantity or flow rate of powdered material P which is fed into jet mill 12 to be micronised is dispensed and determined precisely and kept constantly under control.

For this purpose, microdispenser device 20, which is an essential part of micronisation apparatus 10 according to the invention, transfers and feeds powdered product P from container 11 into micronisation chamber 12*b* of jet mill 12 in a way totally different from and alternative to Venturi type feed systems based on the creation, in a narrow section of a boundary layer, of a negative pressure designed to attract and feed the powdered material from the outside to the micronisation area.

Conversely, microdispenser device 20, as more particularly specified below, is designed to attract and feed powdered product P from container 11 to jet mill 12 via a series of high-frequency pulses imparted to the valves of said microdispenser device 20, which generate pneumatic microtransport of powdered material P along transport lines 14 and 16, and at the same time precisely dispense the quantity transported and fed.

In more detail, microdispenser device 20, which is an integral part of micronisation apparatus 10 according to the invention, is as described in the international patent applications published as WO 03/029762 A1 and WO 2010/11881 A2.

For all further details and clarifications not expressly described herein regarding microdispenser device 20, an essential part of micronisation apparatus 10, reference should therefore be made to said applications, the content of which must be deemed to be incorporated in the description of the present invention.

Figure 2:
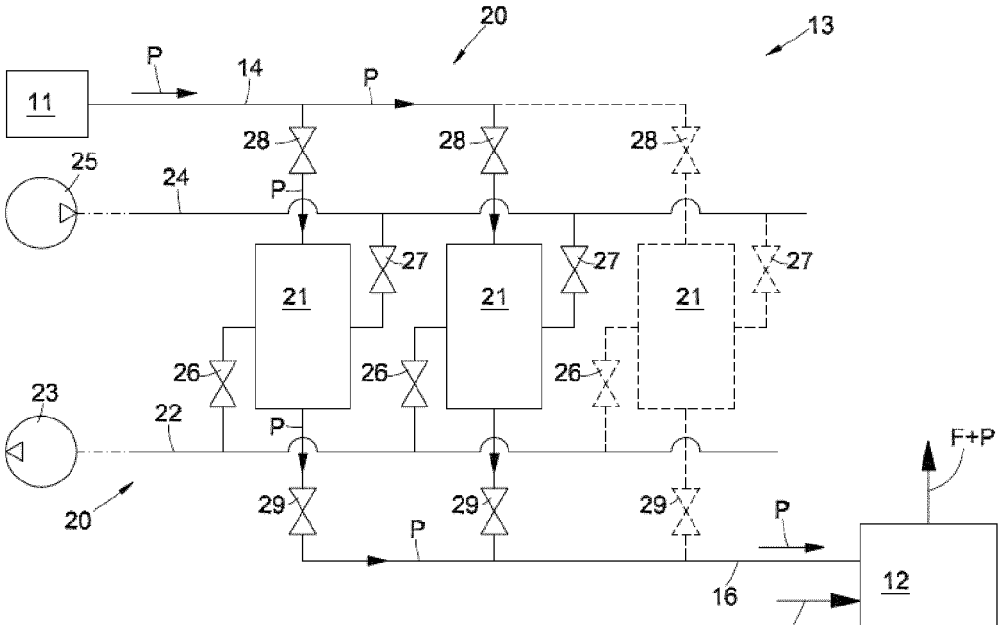
FIG. 2 is a further scheme which illustrates in a little more detail a system, included in the micronisation apparatus shown in FIG. 1, for feeding and dispensing the powdered material to be micronised.

However, for the sake of clarity and completeness information, microdispenser device 20 is schematically illustrated in FIG. 2, and its basic characteristics will be described briefly below.

As already stated, microdispenser device 20 is designed to receive powdered material P from container 11 along inlet line 14 and to feed it, in batched form, through outlet line 16 to micronisation chamber 12*b* of jet mill 12, where powdered material P will be micronised by the effect of high-energy air jets G, acting in said micronisation chamber 12*b*.

In particular, microdispenser device 20 comprises one or more dispensing units or sections, indicated as 21, associated with a suction line 22, wherein a vacuum or negative pressure is created, for example through a suction pump 23, and a pressure line 24, in which a pressure is generated, for example through a pressure pump 25.

A plurality of control valves 26 and 27 are fitted to place each dispensing unit 21 selectively in communication with suction line 22 and pressure line 24 respectively.

The various dispensing units 21 are designed to receive powdered material P from container 11 via transport line 14 and to dispense it, after measuring, to outlet line 16, so that it feeds jet mill 12.

A plurality of control valves 28 and 29 are fitted to place each dispensing unit 21 selectively in communication with inlet line 14 and outlet line 16 respectively.

It is therefore clear that the dispensing process, which is performed with microdispenser device 20 and allows jet mill 12 to be fed with an exactly determined quantity and at an exactly determined flow rate of powdered material, is basically the volumetric/quantitative type.

This dispensing process, as first illustrated, is based on filling dispensing units 21, which in turn define a given volume and consequently a given quantity of powdered material with which they are filled, and subsequent emptying of said dispensing units 21 so as to dispense the powdered material, after measuring, to jet mill 12.

In the operation of micronisation apparatus 10, the operator sets microdispenser 20, via setting and control means and taking account of the characteristics of powdered material P to be micronised, to feed jet mill 12 in the time unit with the desired quantity of powdered material P.

Said setting and control means in turn control the various control valves 26, 27, 28 and 29, namely their opening and closing, via suitable high-frequency pulses so as to cause each dispensing unit 21 to be filled, cyclically and alternately, with powdered material P originating from container 11, and subsequently emptied, thus feeding jet mill 12 with the quantity of powdered material P set by the operator.

In this way powdered material P, which is fed to micronisation chamber 12*b* where it will be micronised, is precisely measured, and its quantity is precisely determined, and kept constantly under control over time.

Microdispenser device 20 presents a special configuration and comprises suitable control and dispensing means, fully and clearly described in the above-mentioned patent applications WO 03/029762 A1 and WO 2010/11881 A2, which have the effect that microdispenser device 20 micrometrically dispenses and measures, in response to suitable commands issued at high frequency to control valves 26, 27, 28 and 29 associated with the various lines 14, 16, 22 and 24 connected with dispensing units 21, the quantity of powdered material P which is introduced into the pipe of outlet line 16 and consequently feeds micronisation chamber 12*b* of jet mill 12.

Powder P, originating from container 11, is therefore suitably micrometrically measured, while it passes through microdispenser device 20, from which it is introduced into the pipe of outlet line 16, so as to feed micronisation chamber 12*b* of jet mill 12.

Powdered material P is also fed to micronisation chamber 12*b* by pneumatic micrometric transport, due to the effect of the high-frequency pulses that control the opening and closing of the various control valves 26, 27, 28 and 29.

The pipes of lines 14 and 16 for the transport of powdered material P to and from microdispenser device 20 respectively are dimensioned on the basis of the maximum flow rates allowable to feed jet mill 12 via feed system 13.

Starting material P, containing the particles to be micronised, which is fed and dispensed through microdispenser 20, can consist of dry powders, a liquid solution or a paste, or a mixture often described by the English term "slurry".

It will also be appreciated that the microdispencer device 20, differently from the traditional pumps, performs the feeding step without any mechanical moving parts in contact with the powdered material.

Still the feeding is made in a dense phase mode, instead of the traditional mechanical and pneumatic transport of the powder.

In this way the powder is flowing at low speed to the milling chamber (normally by the factor 3 to factor 10 lower particles speeds compared to pneumatic powder feeding), with the effect of reducing considerably the wearing.

Experimental Tests

Micronisation apparatus 10 according to the invention, including microdispenser 20, has been subjected to detailed experimental tests with the following purposes:

- to verify the overall operation of said apparatus 10 according to the invention;
- to compare the results obtained with micronisation apparatus 10, an essential part of which is microdispenser device 20, with those obtained with micronisation apparatuses that use a conventional powder feed system, of the Venturi type.

In particular the experimental tests were performed on a micronisation unit or apparatus comprising the following components:

- 5-litre powder container, with powder stirring system;
- pneumatic microdispenser supplied by P&S, of the type described in the above-mentioned patent application WO 03/029762 A1;
- spiral jet mill type MC50, manufactured by Micro-Grinding, suitably modified to allow it to be coupled to the microdispenser, and with a system for recovering the product from a lower zone of the jet mill (version BD of the mill);
- cyclone for separating the micronised powder, with type 50FC filter and incorporated cartridge, for recovery of ultrafine powder particles.

The plant was tested with a powdered product consisting of lactose.

A first series of experimental tests was performed under the following conditions in the test unit:

- relative pressure of gaseous grinding fluid, compared with atmospheric pressure: approx. 7 [barg];
- dose of powdered product: approx. 300 [g/h].

In this first series of tests the spiral or jet mill, in combination with the pneumatic microdispenser, always operated correctly.

Figure 3:
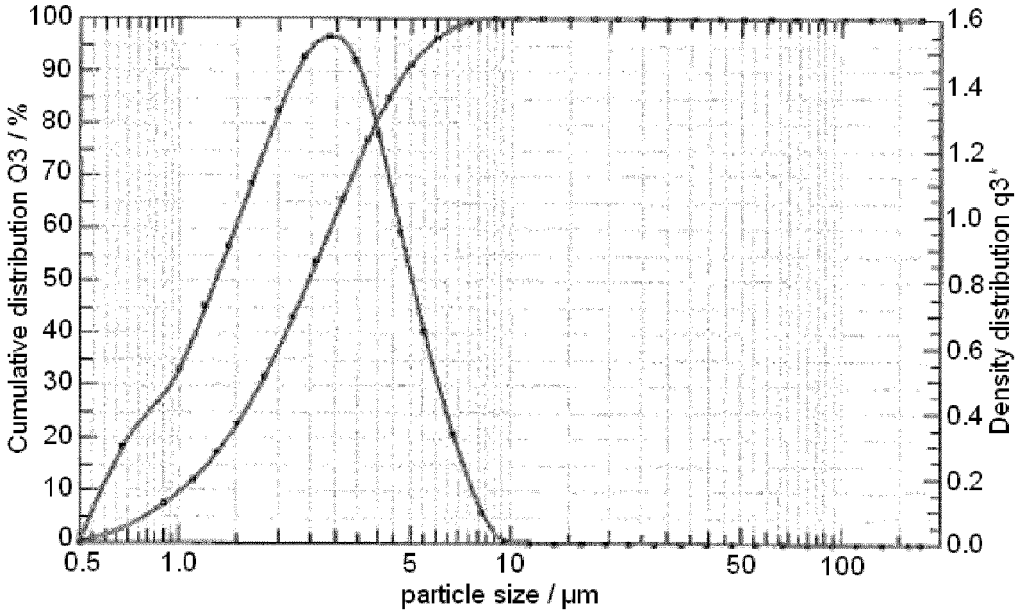
FIG. 3 is a first test report and diagram, showing the results of a first series of experimental tests conducted with the apparatus according to the invention shown in FIG. 1.

For the sake of completeness and to demonstrate said correct operation, the results of the particle-size analysis of the micronised powder output by the jet mill in this first series of tests are specified in the test report shown in FIG. 3.

A second series of tests was performed under the following operating conditions in the test unit:

- relative pressure of gaseous grinding fluid, compared with atmospheric pressure: approx. 9 [barg];
- dose of powdered product: approx. 20 [g/h].
- process gas flow in a range between 10 kg/h and 400 kg/h of compressed gas, or, by considering the ratio between mass of gas and mass of powder, with this ratio in a range between 25 g and 400 g of powder per each ton of compressed gas, or similarly between 25 mg and 400 mg of powder per each kg of compressed gas.

The above operating conditions used in said second series of tests, corresponding to a relatively low flow rate, namely 20 [g/h], of powdered material to the jet mill where it is to be micronised, and a relatively high operating pressure, namely 9 [barg], in the jet mill, designed to generate high-energy fluid jets, are not usually obtainable with conventional micronisation systems, wherein the jet mill is fed with Venturi type feed systems.

Also in this second series of tests the spiral mill or jet mill, in combination with the pneumatic microdispenser, always operated correctly, providing a micronised product complying with the desired quality requirements.

Figure 4:
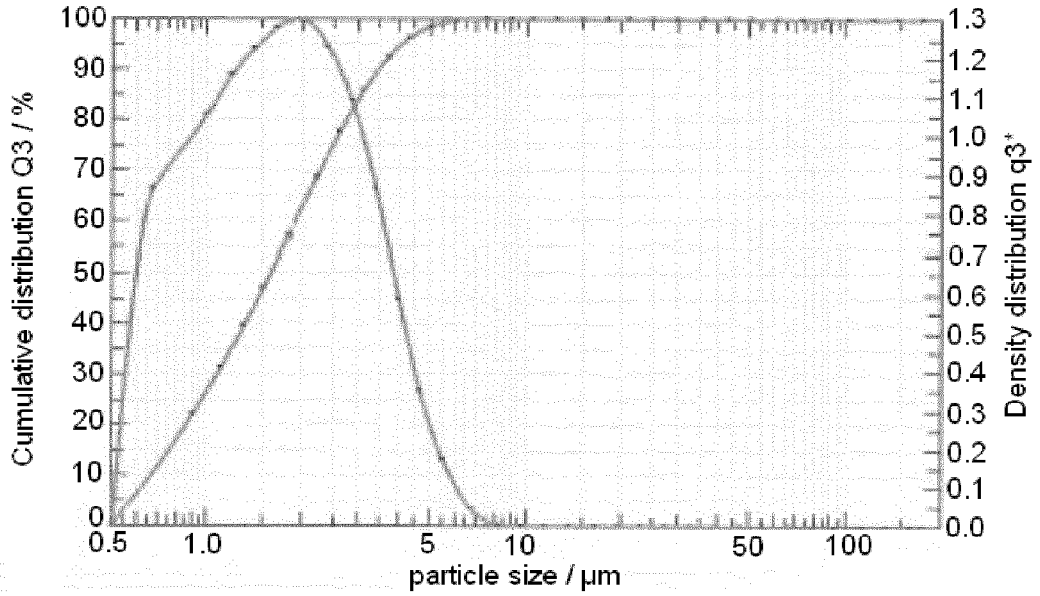
FIG. 4 is a second test report and diagram, showing the results of a second series of experimental tests conducted with the apparatus according to the invention shown in FIG. 1 by feeding it with a relatively low flow rate of powdered material.

For the sake of completeness and to demonstrate said correct operation, the results of the particle-size analysis of the micronised powder output by the jet mill in this second series of tests are specified in the test report shown in FIG. 4.

Briefly, these tests clearly demonstrate that the spiral mill or jet mill, in combination with the pneumatic microdispenser, always operates correctly, under all the operating conditions tested, confirming the innovative characteristics of micronisation apparatus 10 according to the invention.

Figure 5:
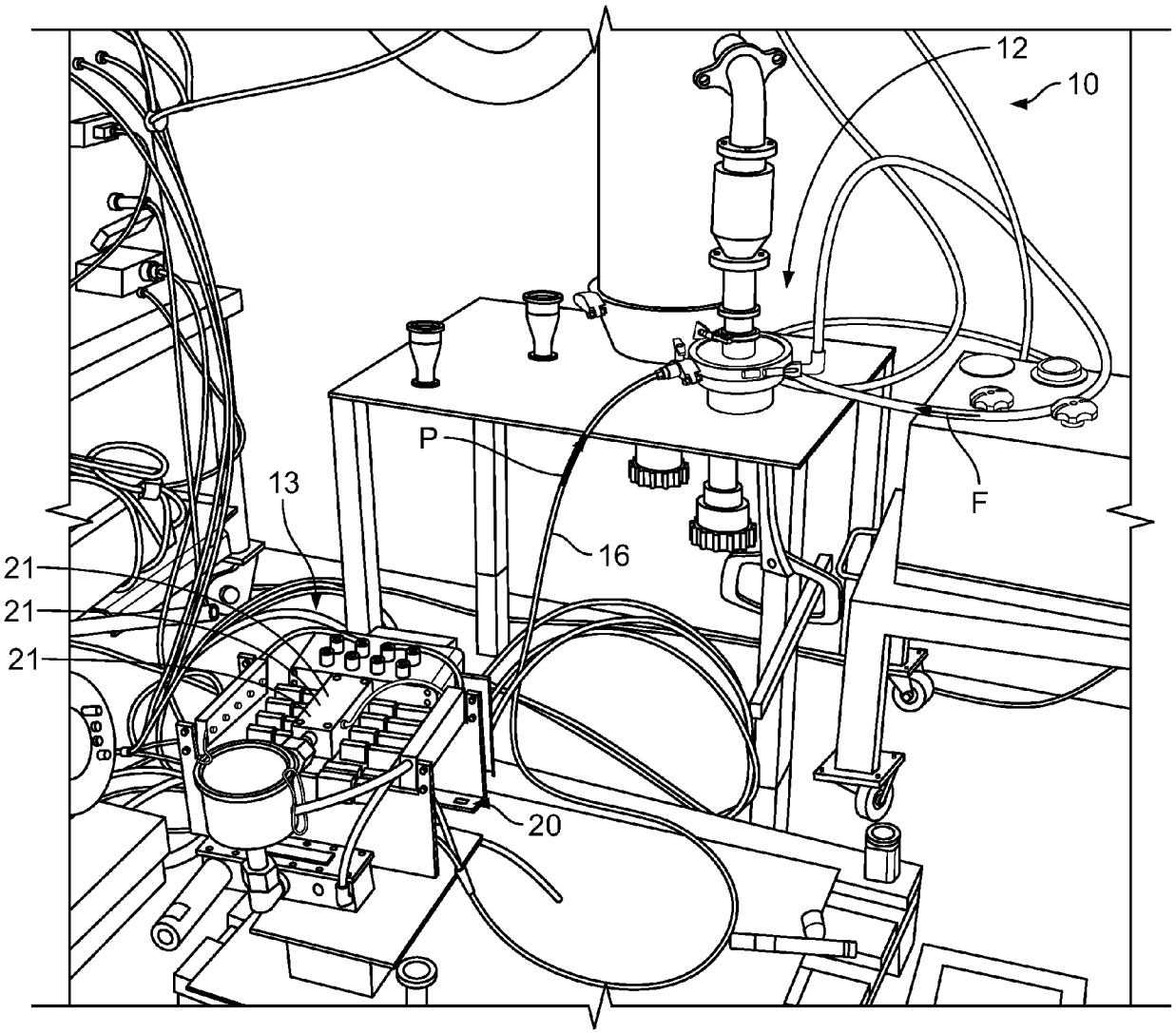
FIGS. 5 and 6 are two photographic images of the actual apparatus used to conduct the experimental tests referred to in the reports shown in FIGS. 3 and 4.
Figure 6:
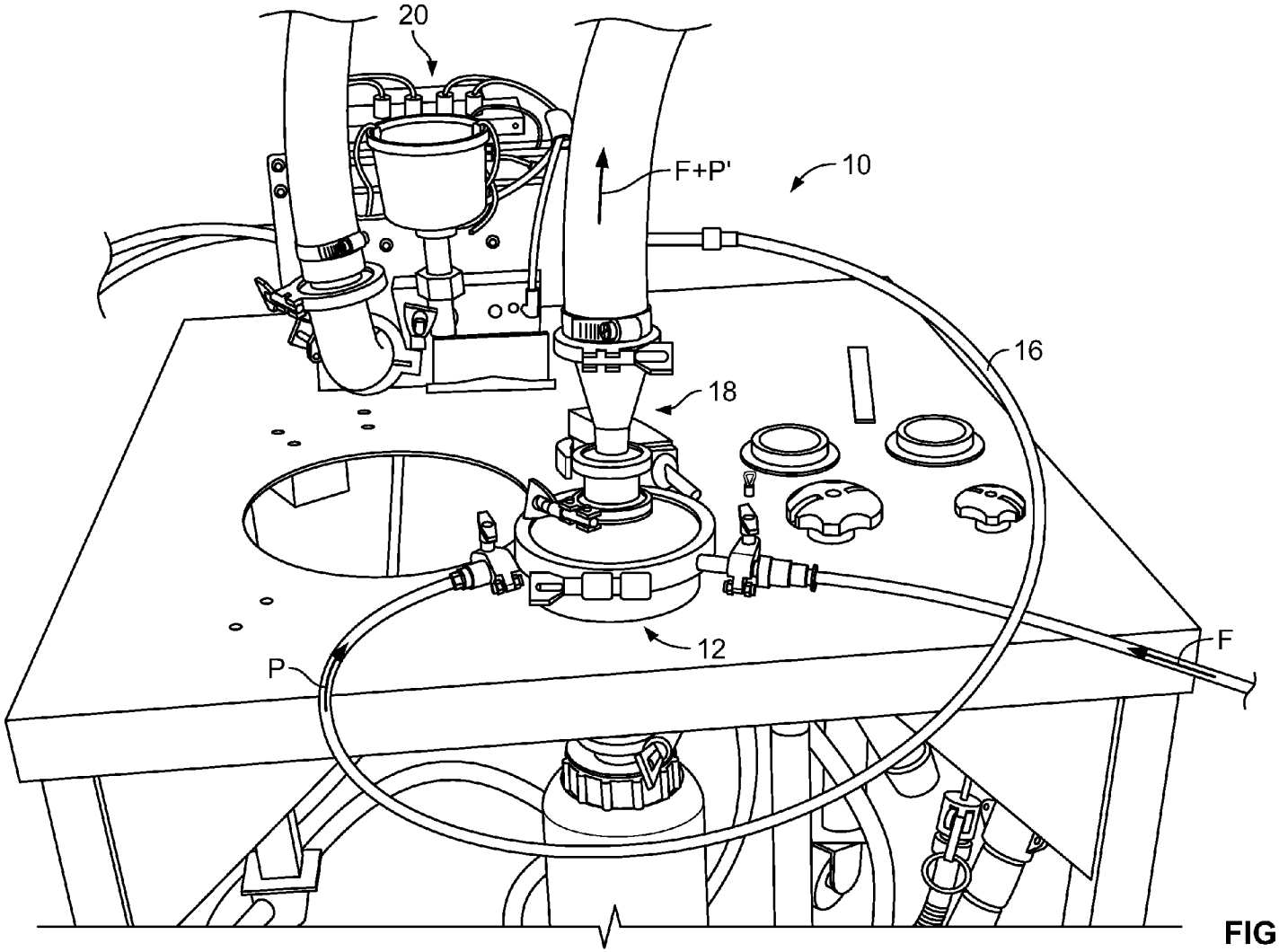

Also for the sake of completeness, the photographic images in FIGS. 5 and 6 show the apparatus according to the invention, including jet mill 12 and microdispenser device 20, which was constructed and used to perform the said experimental tests.

From the above description, it is therefore clear that the present invention fully achieves the intended purposes.

In particular it provides a novel micronisation apparatus or unit which presents significant improvements and better performance compared with the apparatus currently known and used to micronise powders, in particular apparatus designed for use in the pharmaceutical industry, and also allows the quantity of powdered material to be introduced into the micronisation chamber for micronising to be controlled and dispensed with great precision, leading to significant favourable effects on the micronisation process as a whole.

Variations

Variations on micronisation apparatus 10 described above are obviously possible, and also fall within the scope of the present invention.

For example, more than one microdispenser device can be fitted to feed jet mill 12 with different materials containing particles, or different products in powdered form.

The invention claimed is:

1. Apparatus for the micronisation of a powdered material or product, or in general a material containing particles, comprising:

- a container or receptacle, containing a reserve of the powdered material or product to be micronised;
- a micronising mill, specifically of the spiral jet-mill type in which micronising spiral jet-mill the powdered material or product is micronised, said micronising spiral jet mill in turn comprising an annular outer pressure chamber and a circular inner micronisation chamber, separated one another from an annular intermediate wall which is provided with a plurality of channels or through holes, suitably inclined relatively to the radius of the micronisaton chamber, which place the two chambers in communication and which eject a plurality of high-energy jets of a gaseous fluid so as to cause a spiral vortical motion in the circular inner micronisation chamber, and
- a feeding system for feeding the powdered material or product from the container to the mircronising spiral jet-mill, where it is micronised,
- wherein said feeding system comprises a volumetric microdispenser device designed to dispense and feed volumetrically the powdered material or product in a dense state to said micronising spiral jet-mill,
- wherein said volumetric microdispenser device is directly connected via an outlet transport line, for transporting the powdered material from the microdispenser device to the spiral jet-mill, to said inner micronisation chamber of said micronising spiral jet-mill and comprises:
- one or more dispensing units which are associated with a suction line in which vacuum is created and a pressure line in which pressure is generated, a first plurality of control valves which are fitted to place each dispensing unit selectively in communication with the suction line and the pressure line respectively, and a second plurality of control valves are fitted to place each dispensing unite selectively in communication with an inlet transport line, for transporting powdered material from said container to said microdispenser device, and the outlet transport line respectively, for transporting the powdered material from said microdispenser device to said spiral jet-mill, whereby said volumetric microdispenser device is designed to feed the powdered material directly to said inner micronisation chamber, where the powdered material is micronised, and the amount or quantity of the powdered material or product that is dispensed and fed to said spiral jet-mill in order to be micronised is determined in a precise way and is constantly controlled over time.

2. Apparatus for the micronisation of a powdered material or product according to claim 1, wherein said first and second pluralities of control valves are designed to be selectively controlled, namely opened and closed, at high frequency, so as to determine in a cyclic way the filling of said one or more dispensing units with the powdered material coming from said container and their subsequent emptying of the powdered material, so as to feed the measured powdered material to said spiral jet-mill.

3. Apparatus for the micronisation of a powdered material or product according to claim 1, wherein said jet-mill includes a rotary classifier device for the classification of the micronised particles.

4. Apparatus for the micronisation of a powdered material or product according to claim 1, wherein said powdered material or product is constituted by a dry powder, or by a liquid solution or a paste containing particles to be micronised.

* * * * *